US005230724A

United States Patent [19]

Marafante et al.

[11] Patent Number: 5,230,724

[45] Date of Patent: Jul. 27, 1993

[54] DUST FILTER BAG

[75] Inventors: Gentile Marafante, Carnate; Mario Tecchiati, Villa Raverio, both of Italy

[73] Assignee: Vorwerk & Co. Interholding GmbH, Wuppertal, Fed. Rep. of Germany

[21] Appl. No.: 854,419

[22] Filed: Mar. 19, 1992

[30] Foreign Application Priority Data

Apr. 24, 1991 [IT] Italy ..... 359 A/91

[51] Int. Cl.[5] ..... B01D 46/04

[52] U.S. Cl. ..... 55/367; 55/369; 55/376; 55/377; 55/DIG. 2

[58] Field of Search ..... 55/367, 369, 373, 376, 55/377, 508, DIG. 2

[56] References Cited

U.S. PATENT DOCUMENTS 3,237,846 3/1966 Brown ..... 55/DIG. 2 X
3,933,451 1/1976 Johansson ..... 55/376 X
4,961,765 10/1990 Guhne et al. ..... 55/367
5,045,099 9/1991 Goldberg ..... 55/367

FOREIGN PATENT DOCUMENTS 2947613 5/1981 Fed. Rep. of Germany .
3129371 2/1983 Fed. Rep. of Germany .
3535874 4/1987 Fed. Rep. of Germany .
9102596 5/1991 Fed. Rep. of Germany .
2181955 12/1973 France .

*Primary Examiner*—Charles Hart
*Attorney, Agent, or Firm*—Martin A. Farber

[57] ABSTRACT

A dust filter bag (1) for a vacuum cleaner, having a holding plate (2) which has a tightly closed opening (3) for a suction pipe of a vacuum cleaner, the opening (3) being adapted to be closed from the outside by a separate closure flap (5) which has an insertion region (6). In order to achieve more favorable handling, in particular, of the closure flap, the closure flap (5) is detachably connected to the holding plate (2) in its open position.

20 Claims, 3 Drawing Sheets

DUST FILTER BAG

FIELD AND BACKGROUND OF THE INVENTION

The present invention relates to a dust filter bag for a vacuum cleaner, having a holding plate which has a tightly closed opening for a pipe connection of the suction part of a vacuum cleaner, the opening being adapted to be closed from the outside by a separate closure flap which has an insertion region.

Such dust filter bags are already known in various developments. Reference is had in this connection to German Utility Model 78 32 780 and to German Utility Model 90 01 528.

Such dust filter bags usually have a stiffened upper holding plate, for instance of a thicker cardboard material, while the dust filter bag itself usually consists of a cloth-like cellulose material. By means of the holding plate the dust filter bag can be inserted into the apparatus and connected to the aforementioned pipe connection. The opening of the dust filter bag is usually closed by a packing which consists of a circular rubber part resting from the bottom against the opening. This rubber part rests from the inside against the opening with a certain initial tension. When the dust filter bag is inserted into the vacuum cleaner, the packing is forcefully opened by the pipe connection. Upon the removal of the dust filter bag, the packing is to apply itself again against the opening from the inside. Actually, however, this does not take place with the desired reliability, particularly when the dust filter bag is full. When a completely full dust filter bag is removed from the vacuum cleaner, its handling can cause the dust to reemerge very quickly from the inside of the dust filter bag in the form of clouds of dust, which is very unpleasant. In order to remedy this, it has already been proposed in the above-mentioned prior art to provide a separate closure flap by means of which the opening can be closed from the outside upon removal of the dust filter bag. The known closure flap, however, is not satisfactory in every respect. On the one hand, it is occasionally perceived as troublesome upon handling a new dust filter bag, particularly when inserting the bag, while, on the other hand, the closing action of this closure flap is also not yet considered sufficient in all cases.

SUMMARY OF THE INVENTION

Proceeding from the aforementioned prior art, the object of the invention is so to create and further develop a dust filter bag that more favorable handling, in particular of the closure flap, is present.

According to the invention the closure flap is detachably connected to the holding plate in its open position. In accordance with the invention, therefore, the closure flap is not attached in freely moveable manner to the holding plate so that it might therefore interfere with handling upon the insertion of the dust filter bag into the vacuum cleaner. Rather, the closure flap is attached firmly to the holding plate for handling. In this connection, it is preferable that the closure flap be attached to the holding plate by glue, for instance, by a glue spot or circle. This bonding point is only of such size that the closure flap can, when required, readily be detached from the holding plate by deliberate action in the manner that destruction of the closure flap is effected in this event only to an insignificant extent. As further development, the closure flap is basically circular in its insertion region. This is also achieved in the manner that the insertion region is attached to the closure lid by a strip-shaped connecting arm. This strip-shaped connecting arm can be of relatively small width so that the insertion region is of larger circular size. It is important that the insertion region be fastened to the holding plate at a distance from the opening of, for instance, 2.3 cm. In this way, the ability to manipulate the insertion region is facilitated. In addition, it is preferably provided that the insertion region is furthermore detachably connected to the holding plate by a strip-shaped attachment tongue. The detachable connection is effected in detail in one of the manners described above. With such a development, the insertion tab is connected to the closure lid by two additional strips, namely, the connecting strip and the attachment strip, in which connection, however, the attachment strip is detachably connected to the holding plate. It is furthermore preferred that the connecting arm and the attachment tongue be connected to the insertion region in axial extension of each other. It is furthermore proposed that the insertion region have a plurality of insertion tabs. Said insertion tabs serve for engaging below an edge of the opening so as to connect the closure flap in form-locked manner with the holding plate and thus reliably close the opening. An insertion tab can preferably be developed as circular strip. This can be effected in the manner that the insertion region in its circular shape initially covers the opening with a required overlap and then radially inward extending separating slits are developed which extend from the outer edge and by which the insertion tabs are formed. The separating slits preferably have a depth which corresponds approximately to the overlap of the opening. There are furthermore preferably developed a total of four insertion tabs. The separating slits separate the insertion tabs both from each other as well as from the connecting arm and the attachment tongue. The closure flap as well as the holding plate can be made of a reinforced paper material, for instance cardboard.

BRIEF DESCRIPTION OF THE DRAWINGS

The invention will be explained below with reference to the accompanying drawing, which however merely shows one embodiment. In the drawing.

DETAILED DESCRIPTION OF THE PREFERRED EMBODIMENT

Figure 1:
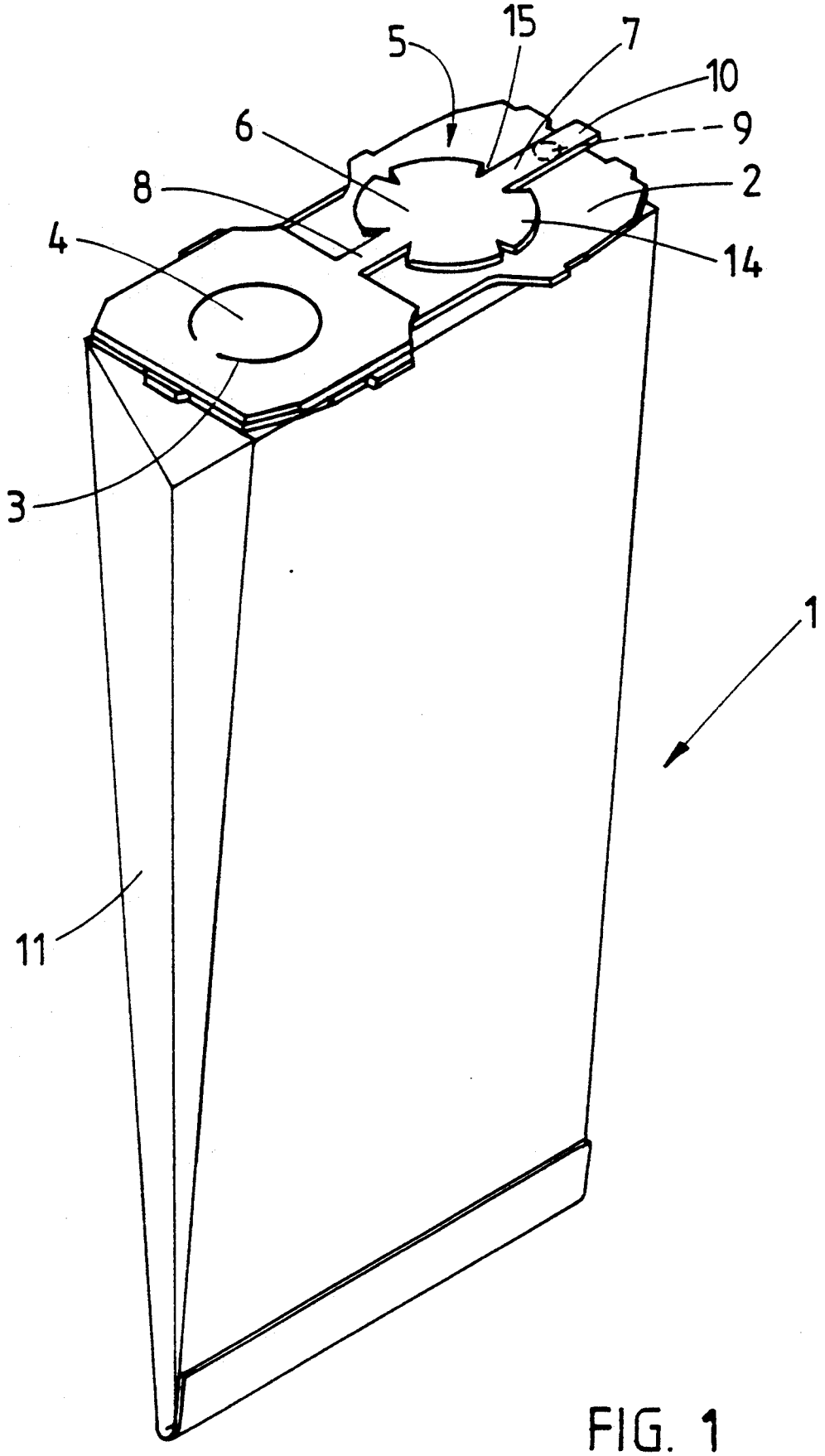
FIG. 1 is a perspective view of a vacuum cleaner bag.

There is shown and described—first with reference to FIG. 1—a vacuum cleaner bag 1 having an upper holding plate 2. The upper holding plate 2 has an opening 3, which is closed by a sealing closure 4 which rests against it from the inside after the first use. Upon insertion of the vacuum cleaner bag into a vacuum cleaner, the sealing closure 4 is pushed inward into the vacuum cleaner bag 1 by a pipe connection of the vacuum cleaner.

In addition, there is a closure flap 5 by means of which the opening 3 can be closed from the outside after use of the vacuum cleaner bag 1, in particular if the vacuum cleaner bag 1 is entirely full.

The closure flap 5 consists of a substantially circular insertion region 6 and an attachment tongue 7 as well as a connecting flap 8. The attachment tongue 7 is detachably connected to the holding plate 2 via a circular glue point 9. The glue point 9 is developed on the attachment tongue 7 or on a place of the holding plate 2 associated with the attachment tongue 7. The glue point 9 is preferably so arranged that an outward protruding area 10 of the attachment tongue 7 remains by means of which the attachment tongue 7 and thus the entire closure flap 5 can, if necessary, be detached from the holding plate 2.

Figure 2:
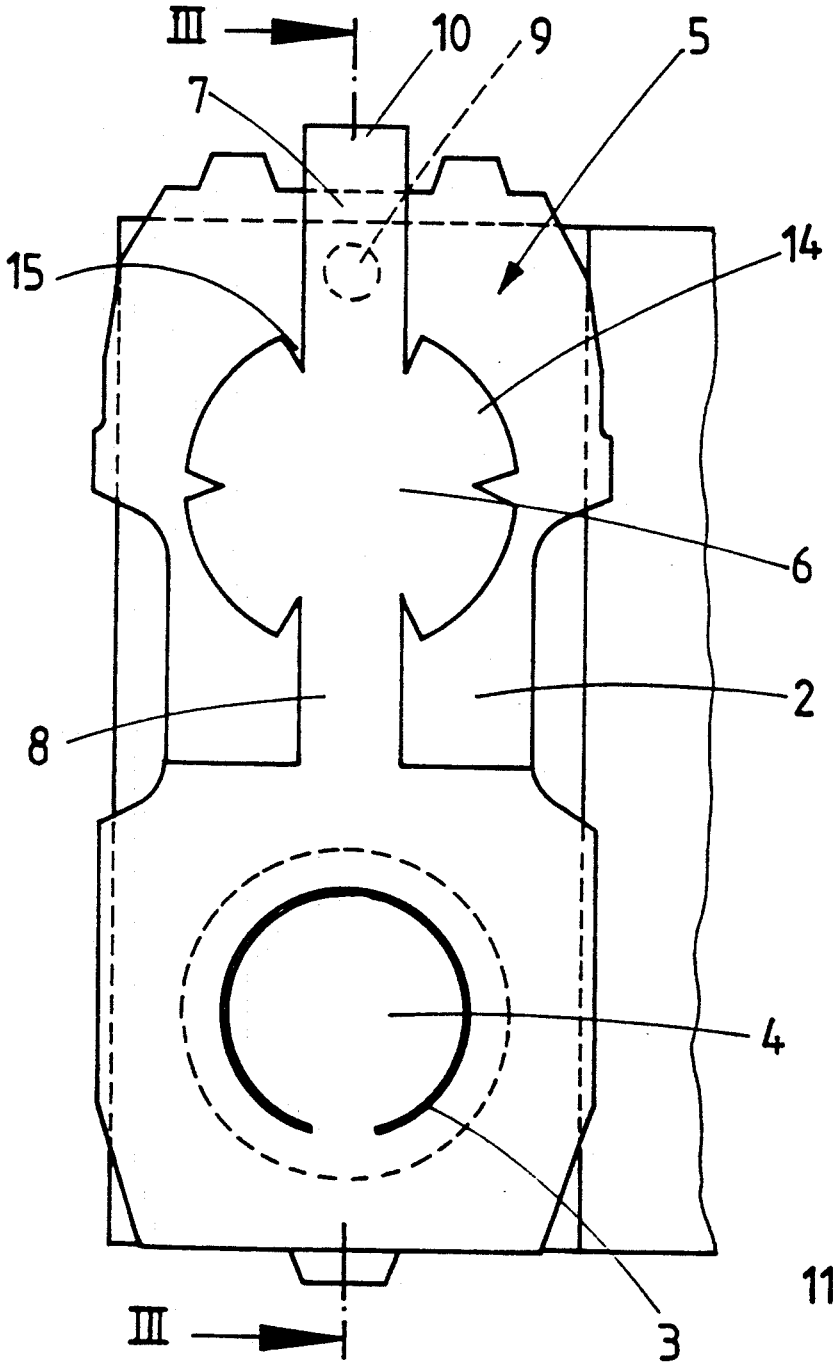
FIG. 2 is a top view of the vacuum cleaner bag with the closure flap open.

The position of the glue point 9 can be noted in particular also from FIG. 2.

Figure 3:
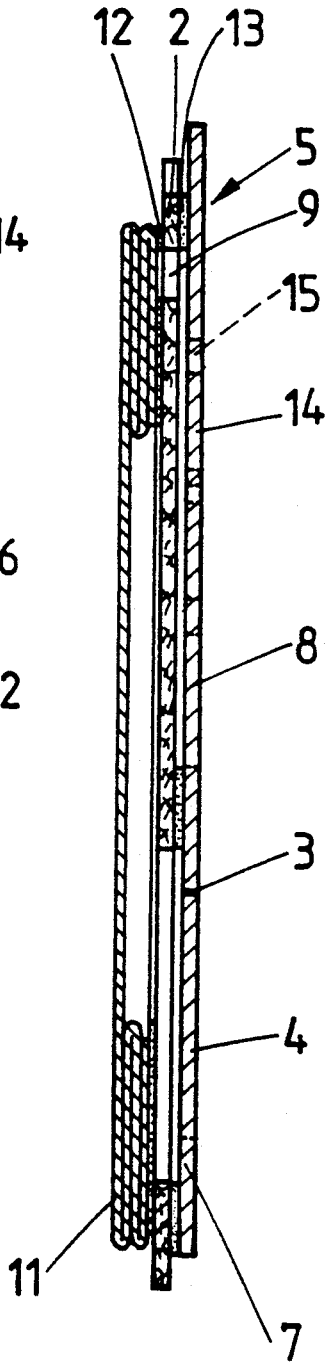
FIG. 3 is a cross section through the showing of FIG. 2 along the line III—III.

As can be noted from FIG. 3, the bag 11 proper is connected via a gluing place 12—as shown in exaggerated fashion in FIG. 3—to the holding plate 2, and the holding plate 2 is then connected via a gluing place 13—also shown in exaggerated size—to the closure flap 5. It is understood that the gluing places 12 and 13 are in each case so developed circumferentially that complete tightness is assured.

Figure 4:
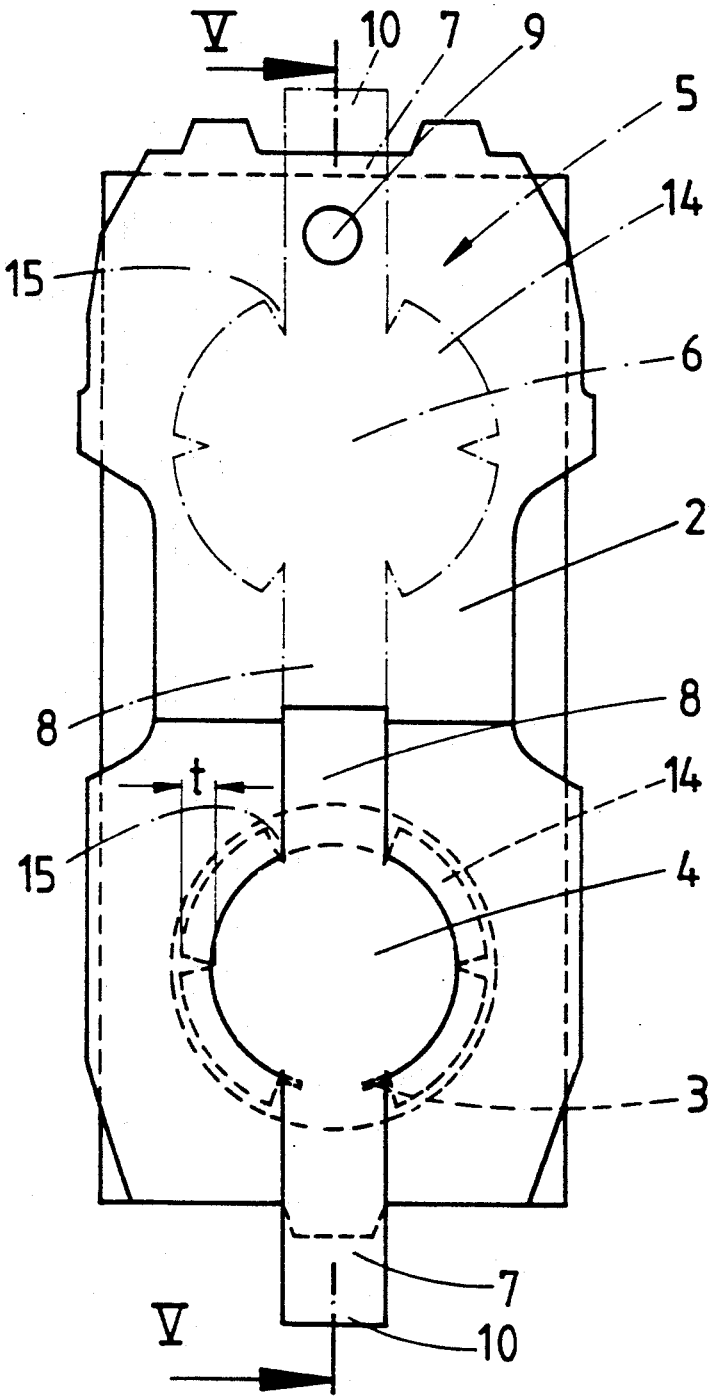
FIG. 4 is a top view of the vacuum cleaner bag with the closure flap closed.
Figure 5:
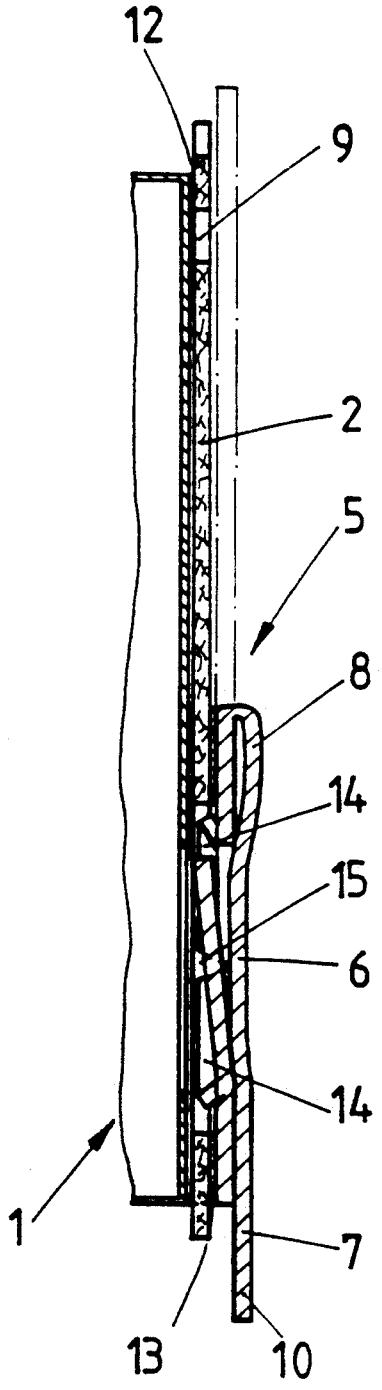
FIG. 5 is a cross section through the showing of FIG. 4 along the line V—V.

In FIG. 4 and 5 the closure flap 5 is shown inserted into the opening 3. It can be noted that each of four insertion tabs 14 which are developed on the insertion region 6 engage under the opening 3 over a depth t. For this purpose the insertion tabs 14 are developed as circular strips and separated via separation slits 14 both from each other and from the connecting strip 8 and the attachment tongue 7. The separation slits 15 are developed with an acute angle, pointing radially inward.

The engagement below the opening 3 can be noted from FIG. 5. It is favorable for handling that four different insertion tabs are developed. Even in the event of incomplete handling in which only one or two insertion tabs engage below the opening 3, a secure covering of the opening 3 by the closure flap 5 is already assured. However, by the circular development of the insertion region 6 and the four insertion tabs 14, as well as the relatively narrow tabs 7 and 8 respectively, which are connected to the insertion region 6 a very complete closure is assured upon engagement of all four insertion tabs 14.

It can also be noted from FIG. 4 that the connecting arm 8 is attached to the holding plate 2 at a, at a distance—in this embodiment about 1.5 cm—from the opening 3. The holding plate 2 consists in this connection of the actual plate body provided with the reference numeral and of the closure flap 5, the latter in any event also reinforcing the actual plate body in the region of the opening 3.

We claim:

1. A dust filter bag for a vacuum cleaner having a holding plate which has a tightly closed opening for a suction pipe of a vacuum cleaner, the opening being adapted to be closed from the outside by a separate closure flap which has an insertion region wherein the closure flap is detachably connected to the holding plate in its open position, and the insertion region of the flap has a plurality of insertion tabs to be inserted into the opening for securely closing the opening.

2. A dust filter bag according to claim 1, wherein the closure flap is glued to the holding plate.

3. A dust filter bag according to claim 1, wherein the closure flap is a circular shape in its insertion region.

4. A dust filter bag according to claim 1, wherein the circular insertion region is connected to the holding plate by a strip-shaped connecting arm.

5. A dust filter bag according to claim 1, wherein the insertion region is detachably connected to the holding plate by a strip-shaped attachment tongue.

6. A dust filter bag according to claim 4, wherein the insertion region is detachably connected to the holding plate by a strip-shaped attachment tongue; and the connecting arm and the attachment tongue are connected to the insertion region in their axial extension.

7. A dust filter bag according to claim 1 wherein the insertion tabs are distributed uniformly about the insertion region.

8. A dust filter bag according to claim 1, wherein an insertion tab has the shape of a circular strip.

9. A dust filter bag according to claim 1, wherein the insertion region has four insertion tabs.

10. A dust filter bag according to claim 6, wherein the insertion tabs are separated from each other and from the connecting arm and the attachment tongue by separating slits corresponding approximately to the extent of their overlap of the opening.

11. A dust filter bag according to claim 4, wherein the insertion region is connected to the holding plate by the connecting arm at a distance from the opening.

12. A dust filter bag for a vacuum cleaner having a holding plate which has a sealing-closed opening for a suction pipe of a vacuum cleaner, the opening being adapted to be closed from the outside by a separate closure flap which has an insertion region, wherein the insertion region of the closure flap has a plurality of insertion tabs.

13. A dust filter bag according to claim 12 wherein the insertion region is connected to the holding plate by a strip-shaped connecting arm;

the insertion region is detachably connected to the holding plate by a strip-shaped attachment tongue; and the insertion tabs are separated from each other and from the connecting arm and the attachment tongue by separating slits.

14. A dust filter bag according to claim 12 wherein the closure flap is glued to the holding plate.

15. A dust filter bag according to claim 12 wherein the closure flap is a circular shape in its insertion region.

16. A dust filter bag according to claim 12 wherein the insertion region has four insertion tabs.

17. A dust filter bag according to claim 12, wherein the insertion tabs are distributed uniformly about the insertion region.

18. A dust filter bag according to claim 12, wherein an insertion tab has the shape of a circular strip.

19. A dust filter bag according to claim 12, wherein the insertion region is circular and the bag further comprises a connecting arm for connecting the insertion region to the holding plate at a distance from the opening.

20. A dust filter bag according to claim 12, wherein the insertion region is connected to the holding plate by a strip-shaped connecting arm;

the insertion region is detachably connected to the holding plate by a strip-shaped attachment tongue; and the connecting arm and the attachment tongue are connected to the insertion region in their axial extension.

an insertion tab has the shape of a circular strip.

* * * * *